United States Patent [19]

Dittberner, Jr. et al.

[11] Patent Number: 4,792,277

[45] Date of Patent: Dec. 20, 1988

[54] SPLIT SHROUD COMPRESSOR

[75] Inventors: Richard H. Dittberner, Jr., Old Saybrook; Harry G. Freschlin, Manchester; Alex Kurti, West Hartford, all of Conn.

[73] Assignee: United Technologies Corporation, Hartford, Conn.

[21] Appl. No.: 70,996

[22] Filed: Jul. 8, 1987

[51] Int. Cl.[4] ..... F04D 29/46

[52] U.S. Cl. ..... 415/160; 415/172 A; 415/190

[58] Field of Search ..... 415/126–128, 415/149 R, 159, 160, 161, 171, 172 A, 174, 189–191, 216–218

[56] References Cited

U.S. PATENT DOCUMENTS

| | | | |
|---|---|---|---|
| 2,671,634 | 3/1954 | Morley | 415/160 |
| 3,026,087 | 3/1962 | Welsh | 415/189 |
| 3,070,352 | 12/1962 | Welsh | 415/189 |
| 3,079,128 | 2/1963 | Burge | 415/191 |
| 3,325,087 | 6/1967 | Davis | 415/150 |
| 3,849,023 | 11/1974 | Klompas | 415/172 A X |
| 4,585,390 | 4/1986 | Pirtle et al. | 415/160 |
| 4,604,030 | 8/1986 | Naudet | 415/171 X |

FOREIGN PATENT DOCUMENTS

| | | | |
|---|---|---|---|
| 486761 | 9/1952 | Canada | 415/160 |

*Primary Examiner*—Robert E. Garrett
*Assistant Examiner*—Joseph M. Pitko
*Attorney, Agent, or Firm*—Edward L. Kochey, Jr.

[57] ABSTRACT

A compressor for a gas turbine engine has a split case and a split stator vane inner shroud. Selected rotatable stator vanes longitudinally restrain the shroud and seal carried thereon to retain the desired roundness.

8 Claims, 3 Drawing Sheets

SPLIT SHROUD COMPRESSOR

TECHNICAL FIELD

The invention relates to gas turbine engines and in particular to a split case compressor using variable pitch vanes.

Axial flow compressors have alternating rows of fixed vanes and moving blades. The fixed vanes are often referred to as the stator ring. The compressor includes an outer casing and the stator ring includes an inner shroud carrying an inner air seal and having vanes extending radially between the case and the inner shroud. This inner shroud supports an abradable seal with a knife edge seal being located on the rotor. Variable pitch stator vanes are used in compressors of gas turbine engines to avoid stall at various operating conditions.

This requires that the vanes be free to rotate around their longitudial axis to effect the various required pitches. Gas turbine engines may be built-up of continuous rings by working axially along the compressor and turbine. These continuous rings provide a uniform structure around the periphery but fabrication and repair is difficult. Such fabrication and later repair is facilitated by using an axially split case. This, however, also requires splitting the inner air seal and inner shroud to which the variable pitch stator vanes are journalled. It has been found that the ends of the split shroud curl inwardly during operation because of temperature differentials imposed on the shroud. This causes rubbing and excessive wear of the seal lands located on the shroud, thus affecting its sealing capability.

DISCLOSURE OF THE INVENTION

A compressor for a gas turbine engine has a split case and variable pitch stator vanes. These vanes are rotatably secured to an inner shroud and selected tension vanes are longitudinally constrained within the split inner shroud. The tension vanes are located at least near the ends of the split inner shroud. In one embodiment a T-shaped bushing interacts with the shroud to permit the tension vanes to hole the shroud ends outwardly. In another embodiment a Woodruff key interlocks the shroud and the tension vanes to accomplish the same result.

BEST MODE FOR CARRYING OUT THE INVENTION

Figure 1:
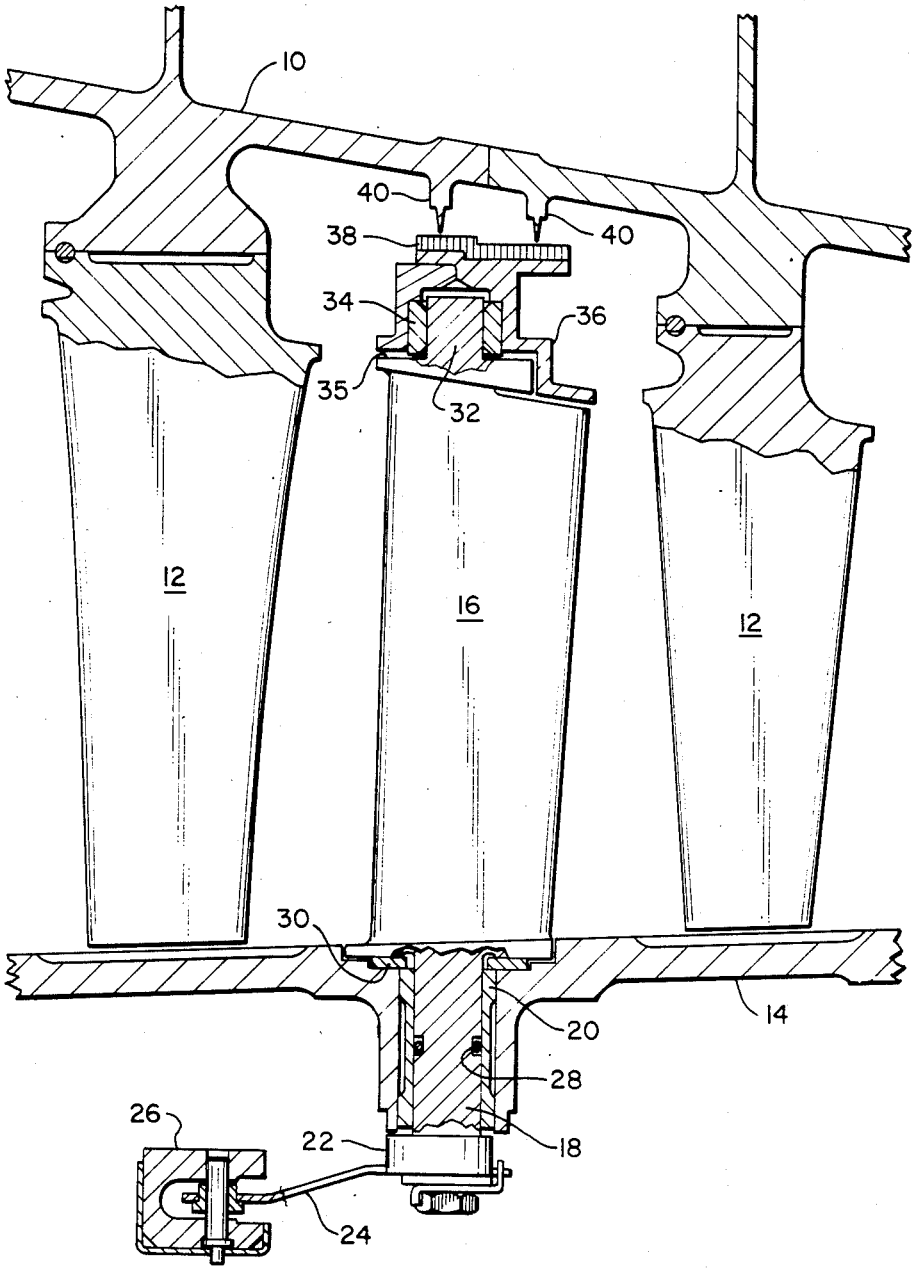
FIG. 1 is partial section through a compressor stage with normal stator vanes.

The compressor of an axial flow gas turbine engine includes a rotor 10 carrying a plurality of stages of blades 12. The stator vanes 16 are variable pitch vanes rotatably mounted with an outwardly extending shaft 18. An actuating arm 24 located on each vane is joined to a unison ring 26 so that the vanes 16 may be all rotated to the desired position.

Seal rings 28 located on the shaft 18 seal against internal pressure while washer 30 accepts thrust loading due to this internal pressure, thereby limiting the movement of blade 16 outwardly with respect to case 14.

The inner edge of each vane 16 includes a longitudinal extension 32 which slidingly fits within bushing 34. This journalled bearing permits rotation of the vane. Bushing 34 also prevents outward motion of the inner shroud contacting inner vane platform 35.

Compressor air loads act axially on the entire stator ring. These loads are resisted by bending moments at bushings 34 and 20. A reasonable length of bushing 34 and 20 along the vane longitudinal axis is required to adaquately resist these bending moments. Bushing 34 fits within inner split shroud 36. The shroud carries a seal land 38 which forms a labyrinth seal with outwardly extending knife edge seal rings 40.

Figure 2:
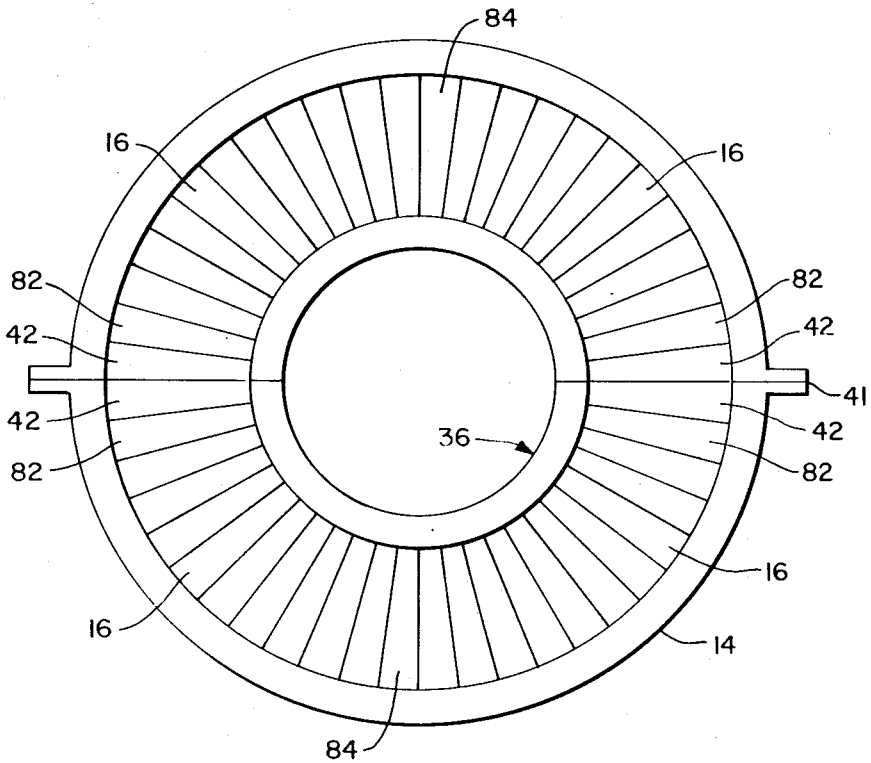
FIG. 2 is a schematic section showing the location of the tension vanes around the circumference of the compressor stage.

As schematically illustrated in FIG. 2 the case 14 is divided into two segments fastened together at case joint 41 with each of the segments being approximately 180 degrees. The inner shroud 36 and the seal ring are also divided into two segments of 180 degrees each. In the particular compressor stage illustrated there are 48 vanes so that the vanes are circumferentially located about 7½ degrees apart. The majority of the vanes 16 are conventionally journalled to the inner shroud 36. This avoids any binding because of longitudinal forces thereby facilitating rotation of the vanes with a minimum of binding.

Operating temperature differentials would cause the inner edges of the shroud to move inwardly or outwardly. While outward motion of the shrouds is prevented as previously described, inward motion would cause rubbing against the seal ring 40. To prevent this, tension vanes 42 are located adjacent to the ends of the inner shroud segments 36 as the first or second vane from the edge. These tension vanes differ from the conventional vanes in that they are not simply journalled to the inner shroud 36 but are arranged to provide an outward force against the shroud. This avoids the inward movement of the shroud, retaining it in its proper location, and avoiding inappropriate seal wear.

Figure 3:
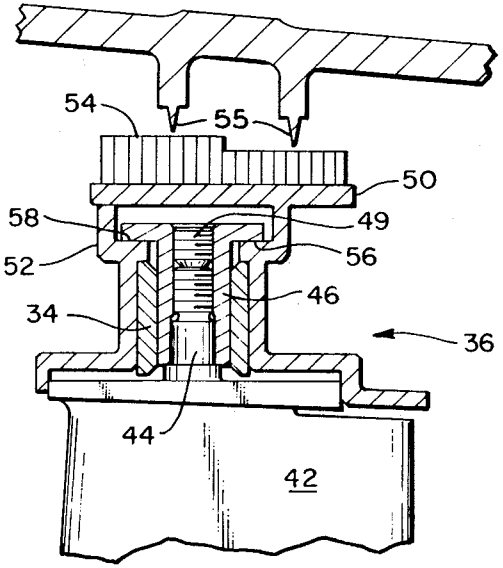
FIG. 3 is illustrates the structure of one embodiment connecting the tension vanes and the inner shroud.

Referring to FIG. 3 tension vane 42 has a threaded longitudinal extension 44 to which is threaded to a T-shaped bushing 46. A set screw 49 also threaded into the bushing operates to lock the T-shaped bushing to the vane. The split inner shroud 36 is divided into two portions 50 and 52 for the purpose of installing bushings 34 and 46 within the assembly. Portion 50 also carries thereon the abradable seal surface 54 which abuts a knife edge seal 55. The bushings also have an inwardly facing surface 56 which abuts an outwardly facing surface 58 of the inner shroud. Forces are transmitted from the outer case through the tension vane 42 and through the bushing to constrain the inner shroud at the ends adjacent to the split. This avoids the excessive distortion and undue wear on the seal surface.

Figure 4:
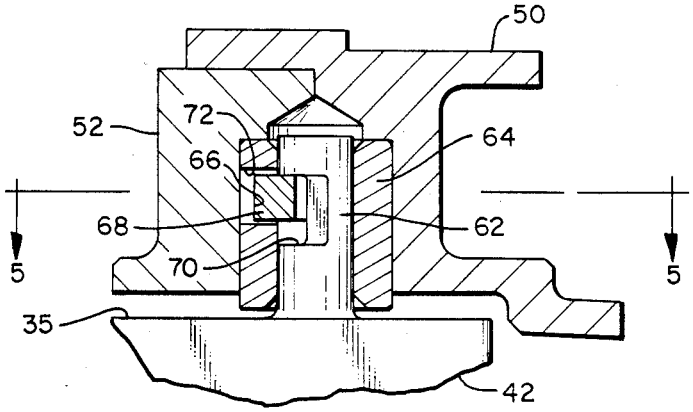
FIG. 4 illustrates the structure of a second embodiment connecting the tension vanes and inner shroud.
Figure 5:
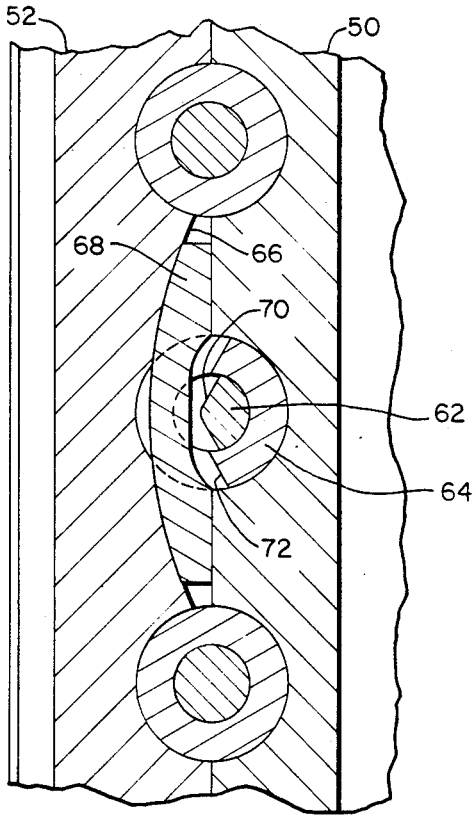
FIG. 5 is a section through FIG. 4.

An alternate embodiment of the constraint is illustrated in FIGS. 4 and 5 wherein the tension vane 42 has an outwardly longitudinally extending cylindrical portion 62 which is substantially identical to the conventional outwardly extending portion 32 except for the slot described later. Bushing 64 is also essentially the same as bushing 34 while the two portions 50 and 52 of the inner shroud also remain the same.

Portion 52 of the shroud has a groove 66 machined therethrough adapted to accept Woodruff key 68. The longitudinally extending shaft 62 has a part depth vane slot 70 machined therein which also accepts a portion of the Woodruff key. Accordingly, the key is locked to the shroud in a direction axial of the tension vane. An opening 72 in bushing 64 permits the Woodruff key 68 to pass therethrough thereby longitudinally locking the tension vane through its shaft 62 to the inner shroud portion 52. This transmits the required forces from the case to the inner shroud thereby preventing the wear problem discussed before. It can be seen that the depth, or radial thickness of the inner shroud is minimized by this design while the bushing 64 still maintains its maximum depth to best resist the bending moments imposed thereon. Accordingly, the forces to resist the thermal distortions are minimized.

Referring back to FIG. 2, it can be seen that an additional tension vane 82 is located adjacent to vane 42 at each end as the first or second vane from vane 42. This is substantially identical to vane 42. While it is unlikely, if not impossible to fabricate these so that the load between vanes 42 and 82 is initially shared, once wear occurs on the vane which is carrying a load, the load will thereafter be shared. Furthermore, a backup tension vane is provided at each location.

A further tension vane 84 may be provided approximately centrally of the split inner shroud segment 14 to facilitate alignment.

We claim:

1. A compressor for a gas turbine engine comprising:
a multi-stage compressor rotor;
an axially split compressor case surrounding said rotor;
at least one stage of a plurality of variable pitch stator vanes, each vane rotatably secured to said case, each vane longitudinally restrained by said case;
a plurality of inner shroud segments segments, each segment extending through an arc of between 45 degrees and 180 degrees;
a seal land secured to the inner surface of each segment;
a knife edge seal secured to said rotor and sealing against each of said seal lands;
said stator vanes each rotatably secured to a shroud segment; and
constraint means for longitudinally with respect to said vane constraining each of said shroud segments from inward movement toward said rotor on only those stator vanes located adjacent to the ends of each shroud segment.

2. A compressor as in claim 1:
said means for longitudinally with respect to said vane constraining each of said shroud segments from inward movement comprising;
said constraint means located on two stator vanes located adjacent to each end of each shroud segment, whereby load is shared after nominal wear and a backup vane exists.

3. A compressor as in claim 1:
said inner shroud segment extending through an arc of substantially 180 degrees.

4. A compressor for a gas turbine engine comprising:
a multi-stage compressor rotor;
an axially split compressor case surrounding said rotor;
at least one stage of a plurality of variable pitch stator vanes, each vane rotatably secured to said case, each vane longitudinally restrained by said case;
a plurality of inner shroud segments, each segment extending through an arc of between 45 degrees and 180 degrees;
a seal land secured to the inner surface of each segment;
a knife edge seal secured to said rotor and sealing against each of said seal lands;
said stator vanes each rotatably secured to a shroud segment; and
constraint means for longitudinally with respect to said vane constraining each of said shroud segments from inward movement toward said rotor on only those stator vanes adjacent to the end of each shroud segment plus one vane located near the middle of each shroud segment.

5. A compressor as in claim 4:
said means for longitudinally with respect to said vane constraining each of said shroud segments from inward movement comprising;
said constraint means located on two stator vanes located adjacent to each end of each shroud segment, whereby load is shared after nominal wear and a backup vane exists.

6. A compressor as in claim 5:
said inner shroud segment extending through an arc of substantially 180 degrees.

7. A compressor for a gas turbine engine comprising:
a multi-stage compressor rotor;
an axially split compressor case surrounding said rotor;
at least one stage of a plurality of variable pitch stator vanes, each vane rotatably secured to said case, each vane longitudinally restrained by said case;
a plurality of inner shroud segments, each extending through an arc of between 45 degrees and 180 degrees;
a seal land secured to the inner surface of each shroud segment;
said stator vanes having a threaded inwardly longitudinal extension;
a T-shaped cylindrical bushing threadedly engaged to said axial extension;
locking means for locking said T-shaped bushing to said longitudinal extension; and
said inner shroud segments each having an outwardly facing bearing surface abuttingly engaging an inwardly facing bearing surface of said T-shaped bushing.

8. A compressor for a gas turbine engine comprising:
a multi-stage compressor rotor;
an axially split compressor case surrounding said rotor;
at least one stage of a plurality of variable pitch stator vanes, each vane rotatably secured to said case, each vane longitudinally restrained by said case;
a plurality of inner shroud segments, each extending through an arc of between 45 degrees and 180 degrees;
a seal land secured to the inner surface of each segment;
a knife edge seal secured to said rotor and sealing against each of said seal lands;
said stator vanes each rotatably secured to a shroud segment;
said stator vanes having a cylindrical extension;

said inner shroud segments having a slot adjacent to said stator vanes and elongated in a direction perpendicular to said cylindrical extension of said vanes;

said cylindrical extension having a part depth vane slot perpendicular to its longitudinal axis and aligned with said shroud slot; and a Woodruff key located within said shroud slot and said vane slot for constraining said vanes from longitudinal movement with respect to said shroud segment.

* * * * *